US007729652B2

(12) United States Patent
Ito et al.

(10) Patent No.: US 7,729,652 B2
(45) Date of Patent: Jun. 1, 2010

(54) BELT FIXING UNIT

(75) Inventors: Hiroshi Ito, Osaka (JP); Chisato Hatakeyama, Osaka (JP); Kunihiko Ishii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 215 days.

(21) Appl. No.: 11/984,657

(22) Filed: Nov. 20, 2007

(65) Prior Publication Data

US 2008/0286017 A1 Nov. 20, 2008

Related U.S. Application Data

(63) Continuation of application No. 11/338,877, filed on Jan. 25, 2006, now Pat. No. 7,317,892.

(30) Foreign Application Priority Data

Jan. 26, 2005 (JP) ..... 2005-017587

(51) Int. Cl.
*G03G 15/20* (2006.01)

(52) U.S. Cl. ..... 399/329; 399/320

(58) Field of Classification Search ..... 219/216; 399/69, 320, 328, 329, 330, 331
See application file for complete search history.

(56) References Cited

U.S. PATENT DOCUMENTS

| | | | | |
|---|---|---|---|---|
| 6,807,386 | B2 * | 10/2004 | Yasui et al. | 399/69 |
| 7,239,838 | B2 | 7/2007 | Sato et al. | |
| 2004/0264991 | A1 * | 12/2004 | Yoshikawa | 399/69 |

FOREIGN PATENT DOCUMENTS

| | | |
|---|---|---|
| JP | 2003-156966 | 5/2003 |

* cited by examiner

*Primary Examiner*—Hoang Ngo
(74) *Attorney, Agent, or Firm*—Smith, Gambrell & Russell, LLP

(57) ABSTRACT

A belt fixing unit has a fixing roller and a pressing roller that are provided in a pair midway along a transport passage through which paper having a toner image formed thereon is transported from bottom to top approximately in a vertical direction and that fix the toner image on the paper, a heating roller that is provided parallel to and in a position approximately horizontal to the fixing roller and that incorporates a heater for heating the fixing roller, and a fixing belt that is formed as an endless belt and that is wound around and between the fixing roller and the heating roller. A non-contact temperature sensor for controlling the fixing temperature is provided on a non-contact basis in the paper passage region on the surface of the upper one of the parts of the fixing belt facing each other up and down between the fixing roller and the heating roller.

13 Claims, 12 Drawing Sheets

BELT FIXING UNIT

CROSS REFERENCE TO RELATED APPLICATION

This application is a continuation of Ser. No. 11/338,877, filed Jan. 25, 2006, now U.S Pat. No. 7,317,892 and which is being incorporated in its entirety herein by reference.

This application is based on Japanese Patent Application No. 2005-17587 filed on Jan. 26, 2005, the contents of which are hereby incorporated by reference.

BACKGROUND OF THE INVENTION

1. Field of the Invention

The present invention relates to a fixing unit using a fixing belt for use in an image forming apparatus such as a color laser printer.

2. Description of Related Art

Japanese Patent Application Laid-open No. 2003-156966 proposes a fixing apparatus (belt fixing unit) as shown in FIG. 16. This fixing apparatus comprises: a pair of rollers, namely a fixing roller 102 and a pressing roller 103, that are provided midway along a so-called horizontal transport passage, that is, a transport passage through which paper having a toner image formed thereon is transported approximately in the horizontal direction; a heating roller 104 that is provided approximately vertically above the fixing roller 102 and that incorporates a heater 105 for heating the fixing roller 102; a fixing belt 101 that is formed as an endless belt wound around and between the fixing roller 102 and the heating roller 104. Here, for the control of the fixing temperature, a non-contact temperature sensor 106 is provided to face the fixing roller 102 from the upstream side thereof with respect to the paper transport direction, with the fixing belt 101 passing therebetween.

In recent years, in comparatively small-size image forming apparatuses such as color laser printers, for further space saving, such models have been becoming increasingly popular as are designed to have smaller footprints by adopting a so-called vertical transport passage (see FIG. 1), that is, a transport passage through which paper having a toner image formed therein is transported from bottom to top approximately in the vertical direction rather than approximately in the horizontal direction.

However, if the arrangement of the temperature sensor (provided to face the fixing roller 102 from the upstream side thereof with respect to the paper transport direction, with the fixing belt 101 passing therebetween) in the belt fixing unit proposed in Japanese Patent Application Laid-open No. 2003-156966 mentioned above is adopted intact in a vertical-transport belt fixing unit (doing so is equivalent to rotating FIG. 16 through 90 degrees clockwise), the sensing surface of the temperature sensor points upward approximately in the vertical direction. This makes the sensing surface prone be soiled with toner, paper dust, and the like falling from the upper part of the transport passage, possibly degrading the sensing accuracy of the temperature sensor.

SUMMARY OF THE INVENTION

In view of the conventionally experienced inconvenience mentioned above, it is an object of the present invention to provide a belt fixing unit that can maintain stable sensing accuracy thanks to its being so constructed that the sensing surface of a non-contact temperature sensor is less prone to be soiled with toner, paper dust, and the like falling from the upper part of a vertical transport passage.

To achieve the above object, according to the present invention, a belt fixing unit is provided with: a fixing roller and a pressing roller provided in a pair midway along a transport passage through which paper having a toner image formed thereon is transported from bottom to top approximately in a vertical direction, the fixing roller and the pressing roller fixing the toner image on the paper; a heating roller provided parallel to and in a position approximately horizontal to the fixing roller and incorporating a heater for heating the fixing roller; a fixing belt formed as an endless belt and wound around and between the fixing roller and the heating roller; and a non-contact temperature sensor for controlling the fixing temperature. Here, the temperature sensor is provided on a non-contact basis in the paper passage region on the surface of the upper one of the parts of the fixing belt facing each other up and down between the fixing roller and the heating roller.

For example, in a construction that includes a housing enclosing the belt fixing unit from around, the temperature sensor is fitted to the housing in a position facing the surface of the fixing belt, with a gap kept from the surface of the fixing belt. Here, near the temperature sensing part of the sensing device provided in the temperature sensor, a wind shield may be provided that points away from the housing toward the fixing belt. This prevents the temperature sensing part of the sensing element from being directly influenced by the stream of air flowing along the surface of the fixing belt, and thus helps reduce the error in the temperature sensed by the temperature sensor. Thus, it is possible to accurately control the fixing temperature.

The wind shield is provided, for example, around the temperature sensing part, or, with respect to the rotation direction of the fixing belt, in an upstream-side part of the temperature sensing part. The wind shield is so structured, for example, that, with respect to the rotation direction of the fixing belt, an upstream-side part of the wind shield protrudes perpendicularly toward the surface of the fixing belt, or that, with respect to the rotation direction of the fixing belt, an upstream-side part of the wind shield protrudes with a gentle slope toward the surface of the fixing belt. It is preferable that an upstream-side part of the wind shield is so shaped as to taper away toward the upstream side with respect to the rotation direction of the fixing belt.

Specifically, as the temperature sensor, one temperature sensor may be provided in a position facing the heating roller, or one temperature sensor may be provided in a position facing the fixing roller, or one temperature sensor may be provided in a position facing the fixing belt that is located, with respect to the rotation direction of the fixing belt, midway between the heating roller and the fixing roller, or two temperature sensors may be provided, one in a position facing the heating roller and another in a position facing the fixing belt.

According to the present invention, the non-contact temperature sensor is provided on a non-contact basis in the paper passage region on the surface of the upper one of the parts of the fixing belt facing each other up and down between the fixing roller and the heating roller. Thus, the sensing surface of the temperature sensor points downward approximately in the vertical direction. This makes the sensing surface of the non-contact temperature sensor less prone to be soiled with toner, paper dust, and the like falling from the upper part of the vertical transport passage. Thus, it is possible to control the fixing temperature stably and accurately.

Providing a wind shield around the temperature sensing part of the sensing device of the temperature sensor helps prevent the temperature sensing part from being directly influenced by the stream of air flowing along the surface of the fixing belt, and thus helps reduce the error in the temperature sensed by the temperature sensor. Thus, it is possible to accurately control the fixing temperature.

DETAILED DESCRIPTION OF PREFERRED EMBODIMENTS

Hereinafter, the best mode of carrying out the present invention will be described with reference to the accompanying drawings, by way of examples that adopt a so-called vertical transport passage through which paper having a toner image formed thereon is transported from bottom to top approximately in the vertical direction.

Figure 1:
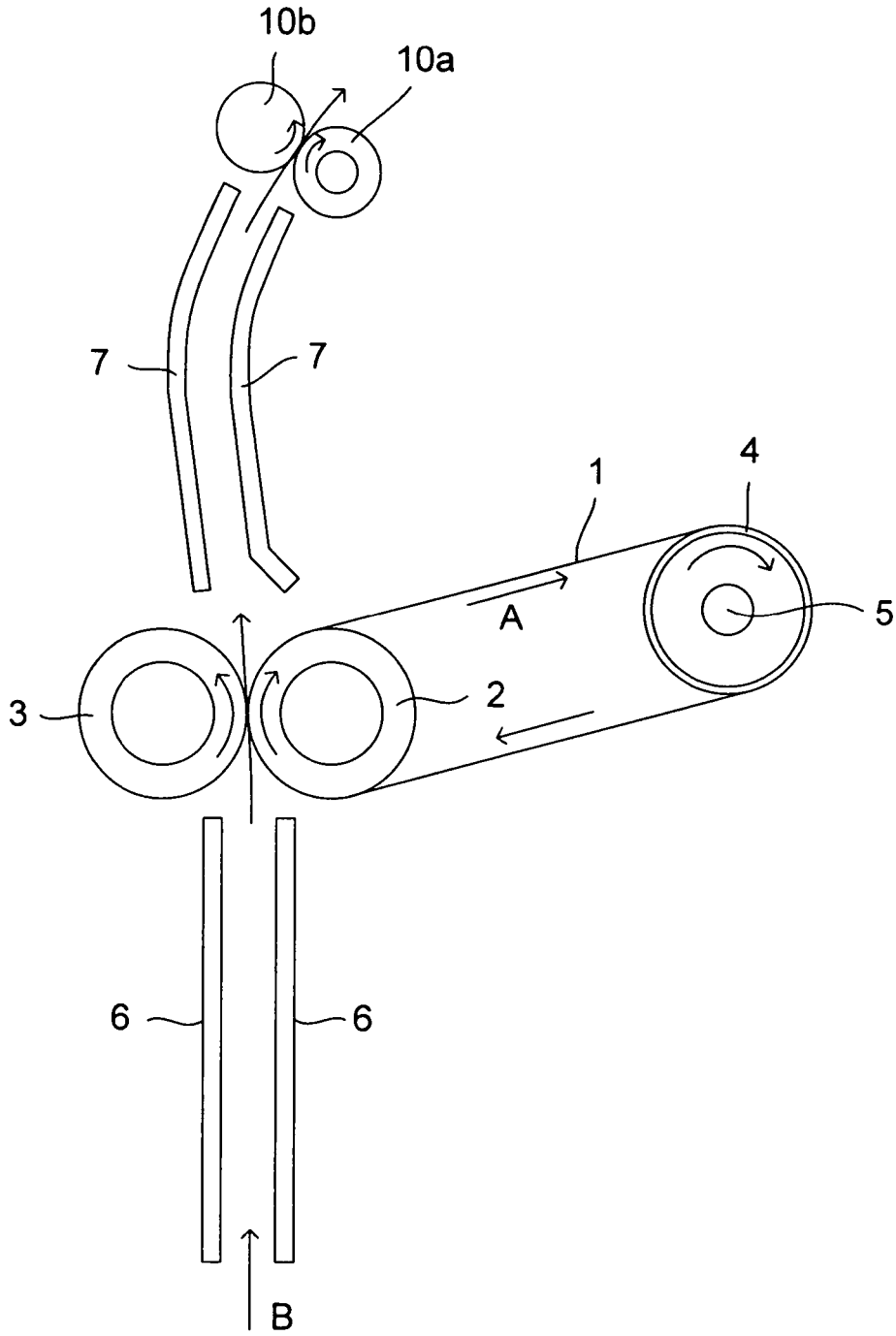
FIG. 1 is a diagram showing an outline of the construction of and around a belt fixing unit embodying the present invention.

FIG. 1 is a sectional view showing an outline of the construction of and around a belt fixing unit in an image forming apparatus. The belt fixing unit is composed principally of a fixing belt 1, a fixing roller 2, a pressing roller 3, and a heating roller 4. The fixing roller 2 and the pressing roller 3 are provided midway along the transport passage. The heating roller 4 is provided parallel to and in a position approximately horizontal to the fixing roller 2. The fixing belt 1 is wound around and between the fixing roller 2 and the heating roller 4, and is driven to rotate in the direction indicated by arrow A by the fixing roller 2. The fixing belt 1 is an endless belt having a thickness of 40 μm and formed of a thin nickel plate, and the outer circumferential surface of the fixing belt 1 is coated with an offset preventing material such as a film of silicone rubber.

The pressing roller 3, placed to face the fixing roller 2, sandwiches transfer paper between itself and the fixing roller 2 so as to press the transfer paper onto the left running part of the fixing belt 1. The fixing roller 2 and the pressing roller 3 are both rubber rollers. The heating roller 4 gives a tension to the fixing belt 1, and is formed as a cylindrical aluminum tube with a wall thickness constant in the axial direction. The heating roller 4 has a hollow interior, where a rod-shaped heater lamp 5 is arranged. The heater lamp 5 heats, via the heating roller 4, the fixing belt 1.

Around the fixing belt 1, there are arranged a pre-fixing guide 6, a post-fixing guide 7, and a pair of transport rollers 10*a* and 10*b*. The pre-fixing guide 6 transports the transfer paper transported from a photoconductive drum toward the belt fixing unit, that is, in the direction indicated by arrow B. The transfer paper is pressed onto the fixing belt 1 and heated, and thereby the toner image that has been transferred onto the transfer paper is fixed. The post-fixing guide 7 and the transport rollers 10*a* and 10*b* eject the transfer paper that has gone through the fixing process into a tray provided outside the image forming apparatus.

Figure 2:
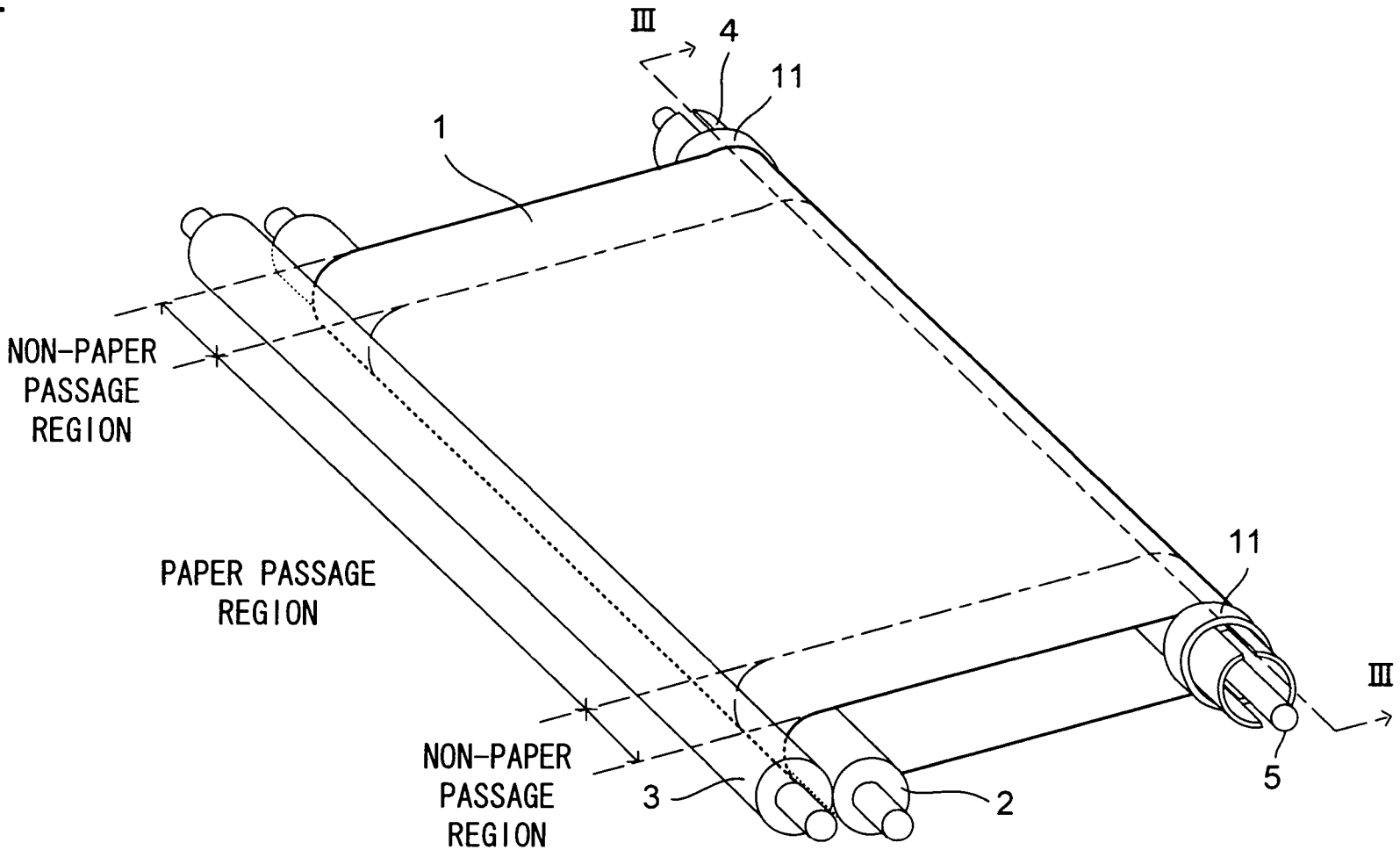
FIG. 2 is a perspective view of the belt fixing unit shown in FIG. 1, with the brackets and stop rings therefor omitted.
Figure 3:
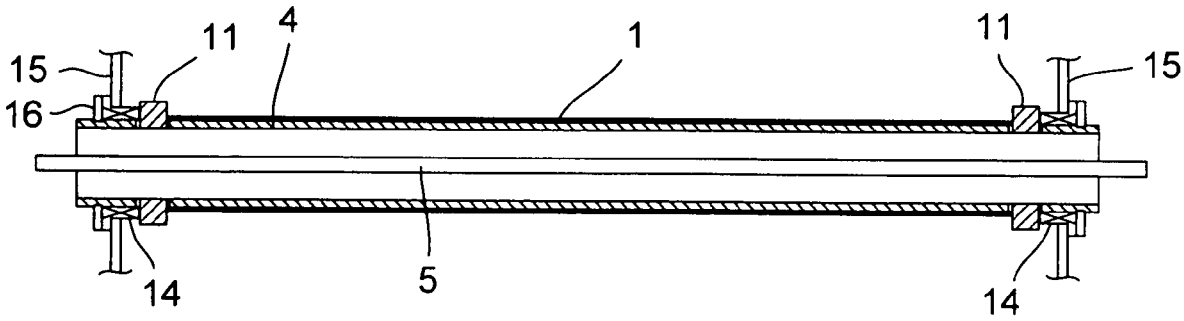
FIG. 3 is a sectional view along line III-III shown in FIG. 2.

As shown in FIGS. 2 and 3, two meandering preventing members 11 are fitted one near each end of the heating roller 4. The distance between the two meandering preventing members 11 is set to be slightly greater than the width of the fixing belt 1. The heating roller 4 is, at the parts thereof outside where the meandering preventing members 11 is fitted thereto, rotatably supported on brackets 14. The brackets 14 are fitted to side plates 15 of the belt fixing unit. The brackets 14 also serve as stoppers for preventing the meandering preventing members 11 from falling off. Further outside, at the very ends of the heating roller 4, C-shaped stop rings 16 are fitted to prevent the brackets 14 from falling off.

Now, how the fixing temperature is controlled in the belt fixing unit constructed as described above will be described by way of different embodiments of the present invention.

Figure 4:
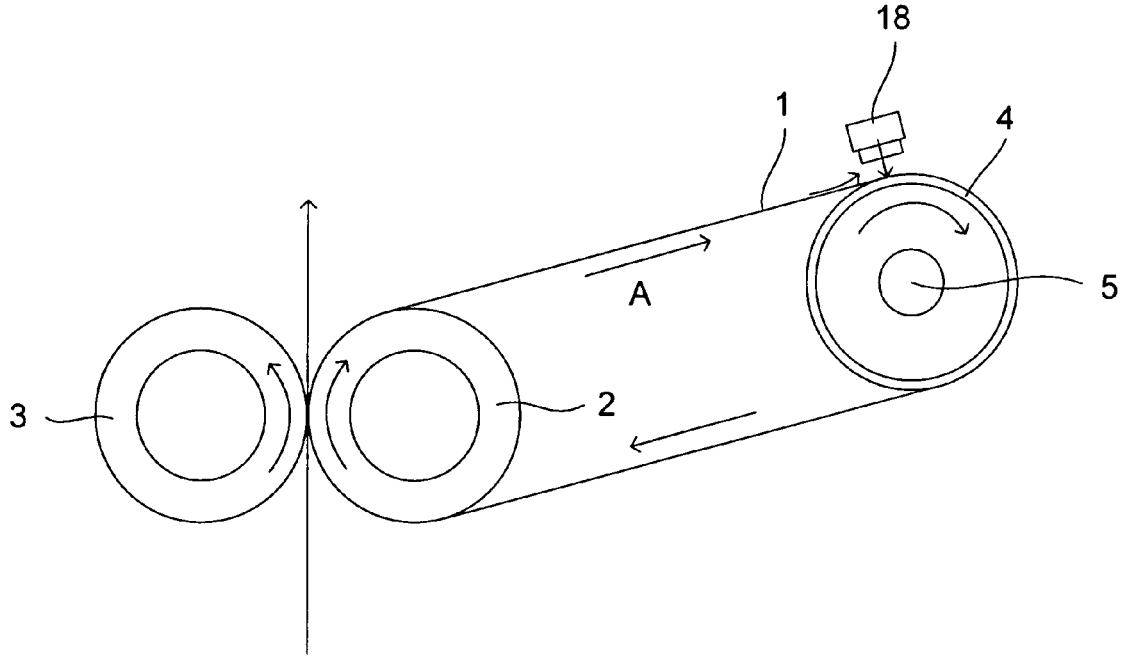
FIG. 4 is a diagram showing an outline of the construction of a first embodiment for controlling the fixing temperature in the belt fixing unit embodying the present invention.

First, a first embodiment of the present invention for controlling the fixing temperature will be described with reference to FIG. 4. As shown in FIG. 4, a non-contact temperature sensor 18 is provided on a non-contact basis in the paper passage region on the surface of the fixing belt 1, in a position facing the heating roller 4. The non-contact temperature sensor 18 here exploits infrared radiation to sense temperature. With the temperature sensor 18 so arranged, the surface temperature of the fixing belt 1 is sensed at the part thereof close to the heater lamp 5. This offers the advantage that the result of the sensing can be directly reflected in how the heating of the belt is controlled.

Figure 5:
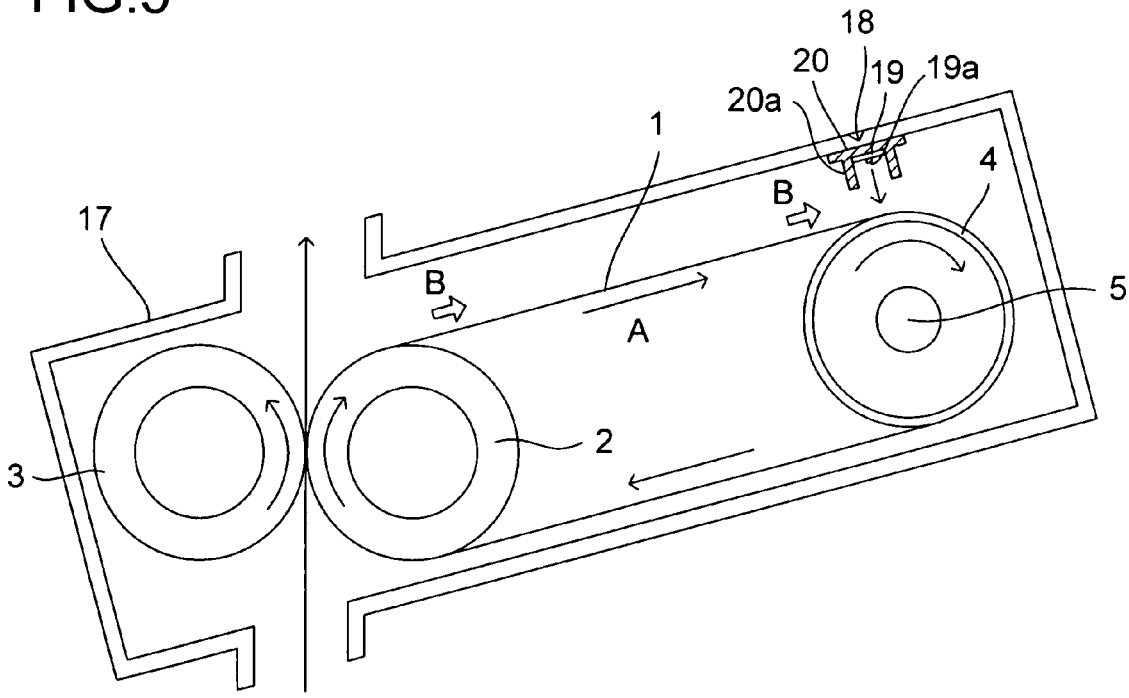
FIG. 5 is a diagram showing an outline of the construction of an example in which a fence (wind shield) is provided around the temperature sensing part of the sensing element of the temperature sensor provided in the above belt fixing unit.
Figure 8:
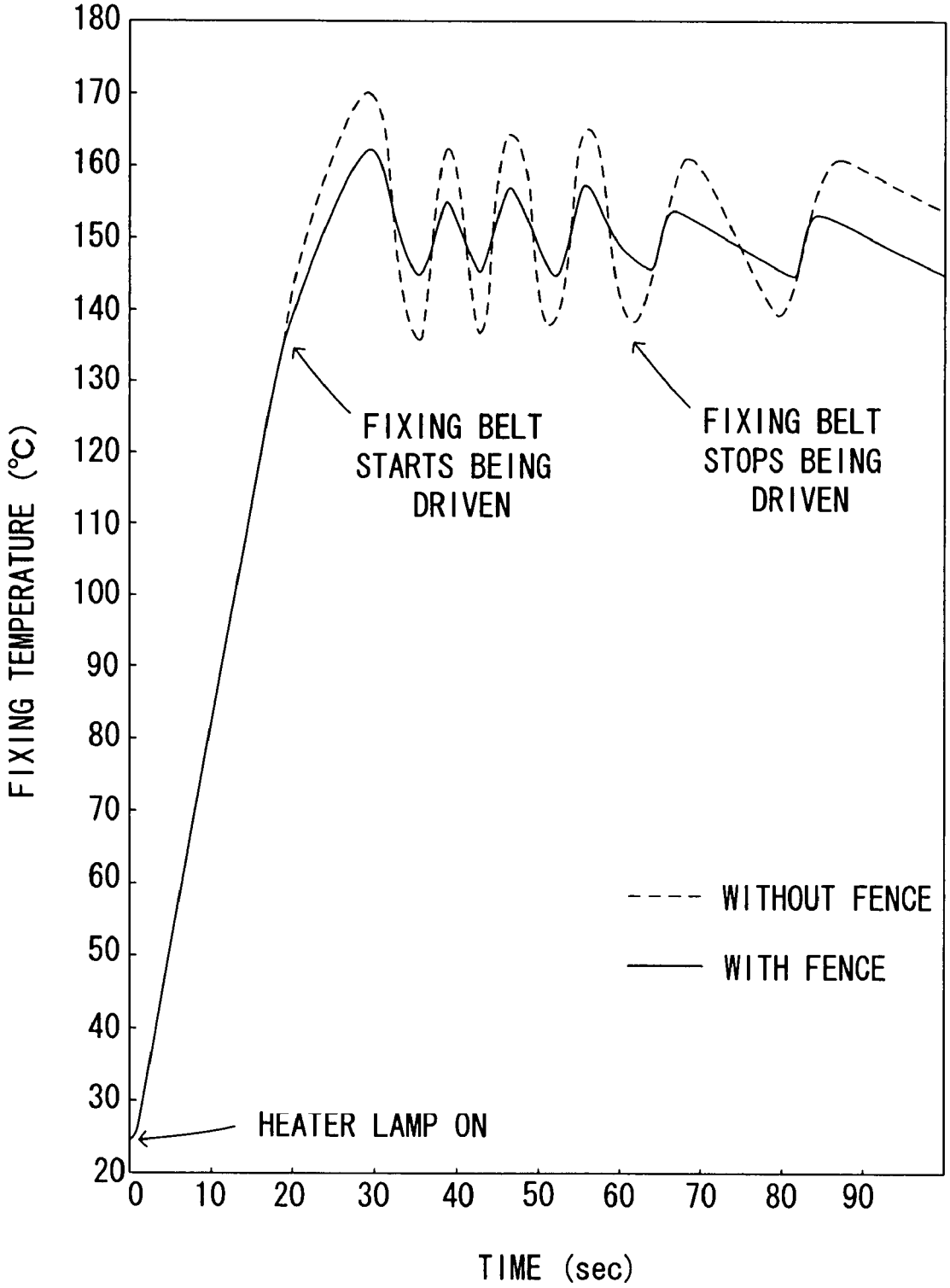
FIG. 8 is a diagram showing examples of the change of the fixing temperature during the warming-up of the heater lamp, illustrating the difference in the accuracy with which the fixing temperature is controlled with and without the fence.

Here, the belt fixing unit employs the heater lamp 5 as a heat source, and therefore, for accurate control of the fixing temperature within a narrow temperature range, it is so constructed as not to be influenced by the wind for interior cooling, that is, the cooling of the interior of the body of the image forming apparatus. For example, as shown in FIG. 5, the belt fixing unit as a whole is enclosed in a housing 17 so that the surface of the fixing belt 1 is exposed to as little wind for interior cooling as possible. Even then, when the belt fixing unit is in operation, as the fixing belt 1 rotates in the direction indicated by arrow A, a stream of air is produced that flows along the belt surface in the direction indicated by arrow B. As a result, with this non-contact temperature sensor 18, because of the gap between the belt surface of the fixing belt 1 and the temperature sensing part 19*a* of the sensing element 19, a larger error tends to arise in the sensed temperature than with a contact temperature sensor. Thus, as indicated by a broken line in FIG. 8, the fixing temperature fluctuates in a wide temperature range, and consequently, quite inconveniently, the fixing temperature is controlled with lower accuracy than expected.

Figure 6:
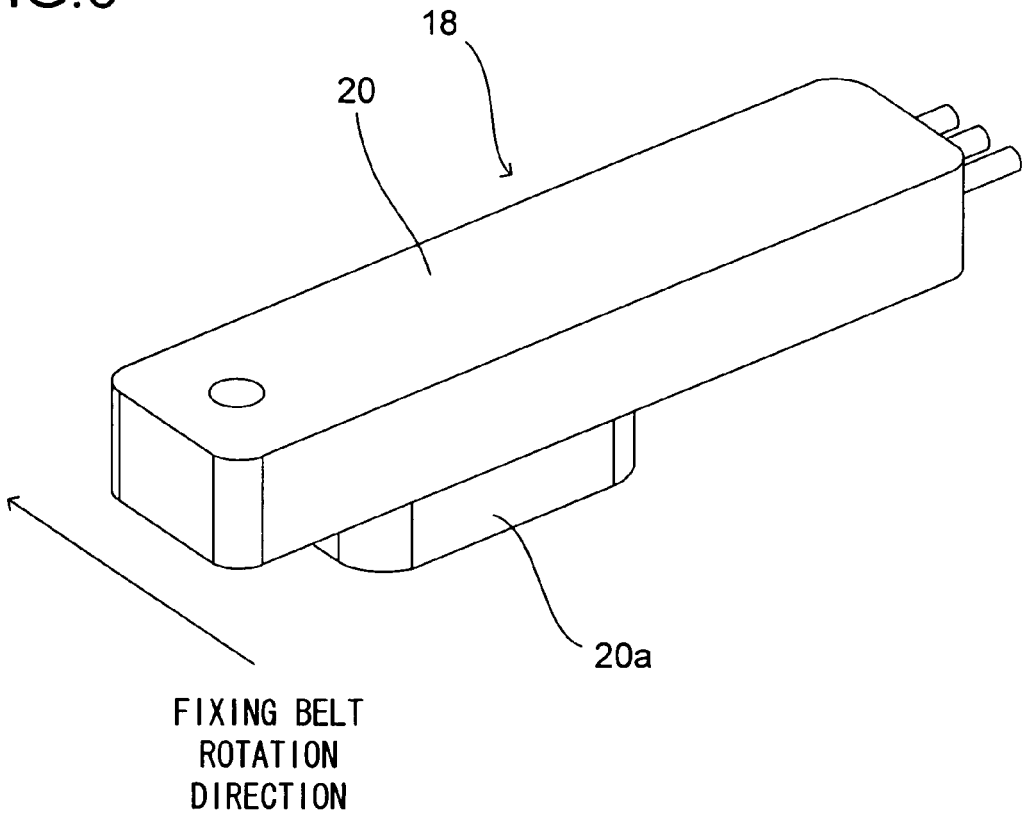
FIG. 6 is a perspective view of the above temperature sensor as seen from above.
Figure 7:
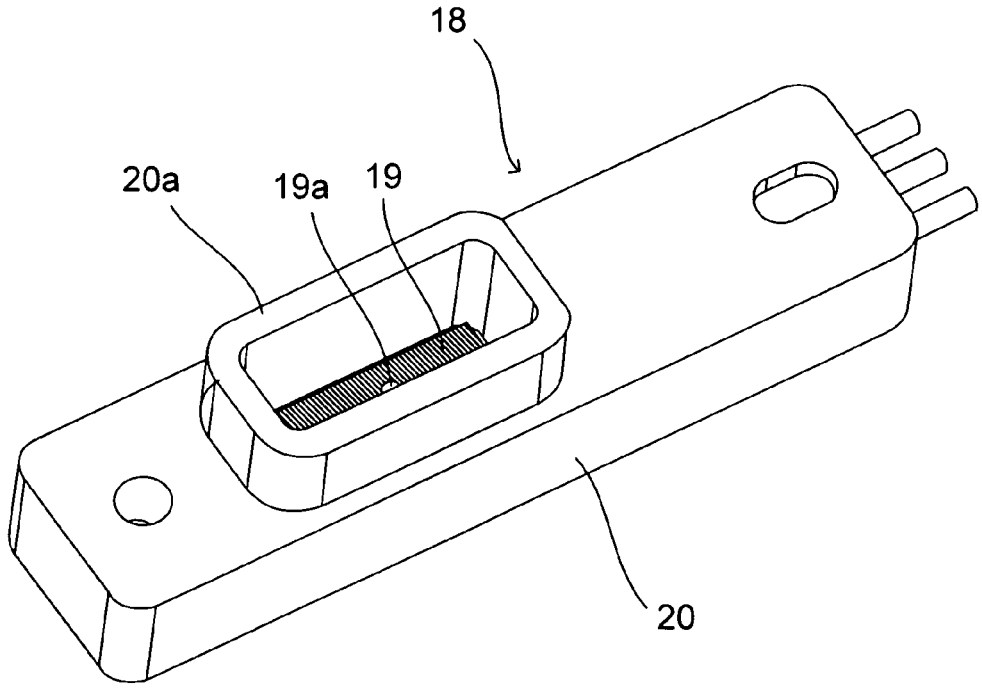
FIG. 7 is a perspective view of the above temperature sensor as seen from below.

An example of a sensor structure that helps reduce such a sensing error are shown in FIGS. 6 and 7. As shown in these figures, on the bottom face of a frame 20 to which the sensing element 19 is fitted, a fence 20*a* in the shape of an enclosing wall is formed, and the sensing element 19 is fitted to the frame 20 so that the temperature sensing part 19*a* is located inside the fence 20*a*. As shown in FIG. 5, the fence 20*a* is so shaped as to protrude vertically toward the surface of the fixing belt 1. Shaping the fence 20*a* in this way helps make it compact, and makes it easy to build a wind shield into the temperature sensor 18.

With this sensor structure, as shown in FIG. 5, the fence 20*a* of the frame 20 serves as a wind shield, and thereby prevents the temperature sensing part 19*a* of the sensing element 19 from being directly influenced by the stream of air flowing along the fixing belt 1. This helps reduce the error in the temperature sensed by the temperature sensor 18, and makes it possible to control the fixing temperature accurately.

Figure 9:
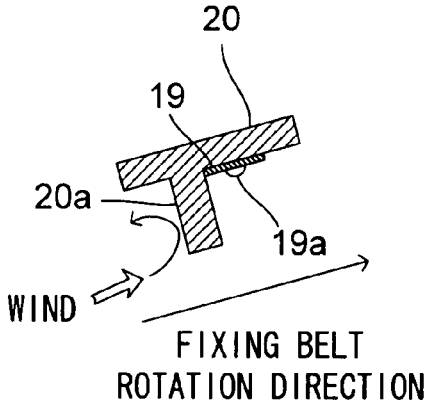
FIG. 9 is a sectional view, along the rotation direction of the fixing belt, of a temperature sensor having a fence only on the upstream side thereof with respect to the rotation direction of the fixing belt.
Figure 10:
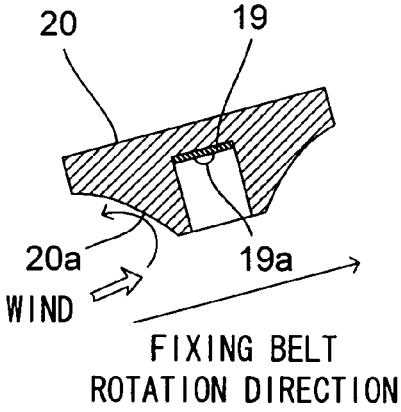
FIG. 10 is a sectional view, along the rotation direction of the fixing belt, of a temperature sensor having a fence so shaped as to protrude gently toward the surface of the fixing belt.
Figure 11:
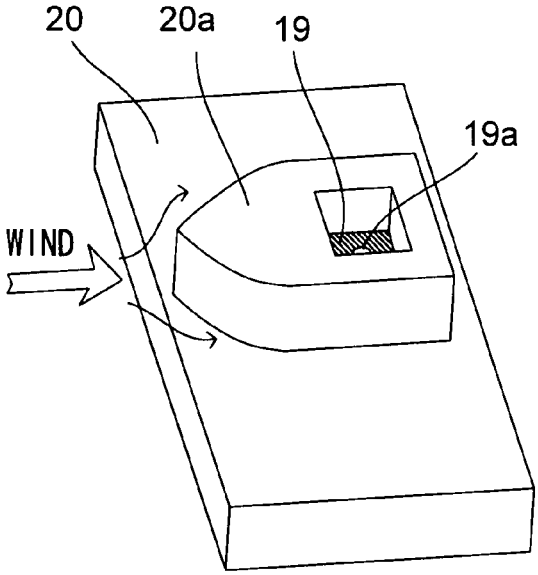
FIG. 11 is a perspective view, as seen from below, of a temperature sensor having a fence whose upstream-side part with respect to the rotation direction of the fixing belt is shaped like a thread-spinning spindle.

It should be understood that the position, structure, and shape of the temperature sensor shown in FIGS. 5 to 7 are merely an example, and are not meant as any limitation. For example, since the fence 20*a* of the frame 20 has simply to prevent the influence of the stream of air flowing along the surface of the fixing belt 1, it does not necessarily have to be provided all around the temperature sensing part 19*a* of the sensing element 19, but may be provided only on the upstream side of the temperature sensing part 19*a* with respect to the rotation direction of the fixing belt 1 as shown in FIG. 9. The fence 20*a* may, instead of being so shaped as to protrude perpendicularly toward the surface of the fixing belt 1 as shown in FIG. 5, may be so shaped as to protrude with a gentle slope toward the surface of the fixing belt 1 as shown in FIG. 10. With the fence 20*a* so shaped, the wind changes its direction gently, and thus produces less disturbed streams, leading to a stable wind-shielding effect. Alternatively, as shown in FIG. 11, the upstream-side part of the fence 20*a* with respect to the rotation direction of the fixing belt 1 may be so shaped as to taper away (wedge-shaped) toward the upstream side. With the fence 20*a* so shaped, the wind produced by the rotation of the belt can be diverted away, leading to a stable wind-shielding effect.

In the embodiment described above, with the fence 20*a* provided on the frame 20, the sensor module itself is so shaped as to form a wind shield around the temperature sensing part 19*a* of the sensing element 19. Instead of this, for example, an enclosing wall may be formed on the inner wall of the housing 17, with the sensing element 19 arranged inside it. That is, such a structure may be realized in the belt fixing unit as a whole.

Figure 12:
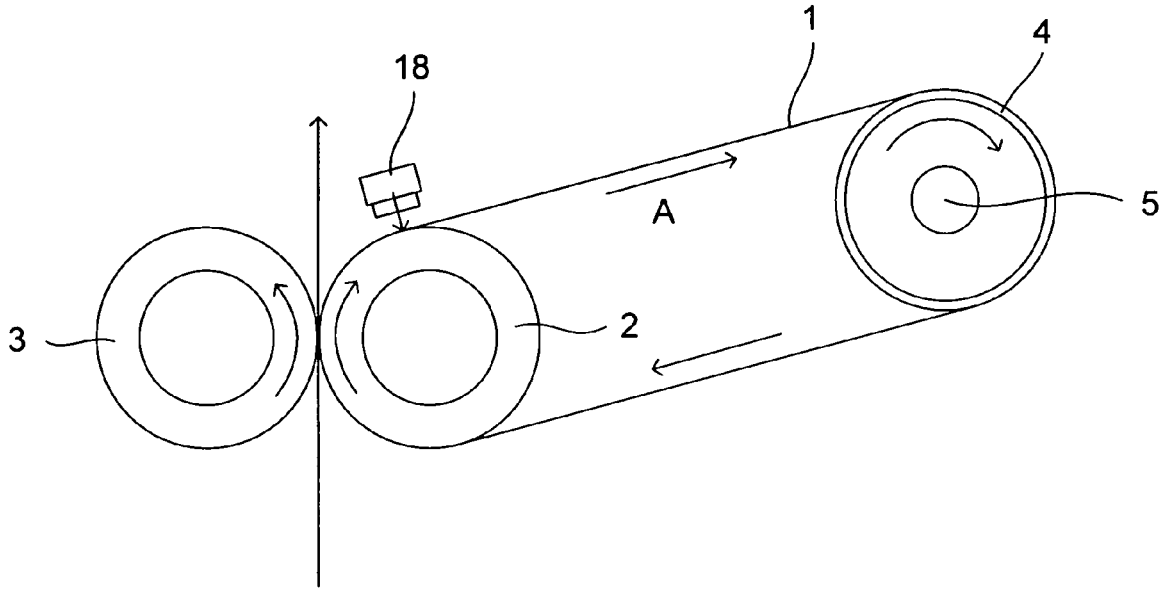
FIG. 12 is a diagram showing an outline of the construction of a second embodiment for controlling the fixing temperature in the belt fixing unit embodying the present invention.

A second embodiment of the present invention for controlling the fixing temperature will be described below with reference to FIG. 12. As shown in FIG. 12, a non-contact temperature sensor 18 is provided on a non-contact basis in the paper passage region on the surface of the fixing belt 1, in a position facing the fixing roller 2. With the temperature sensor 18 so arranged, the surface temperature of the fixing belt 1 is sensed at the part thereof close to the fixing position (where the fixing roller 2 and the pressing roller 3 are in pressed contact with each other). This offers the advantages that how much heat is consumed with respect to the actual fixing temperature can be accurately known, and that the result of the sensing can be directly reflected in how the fixing temperature is controlled.

Figure 13:
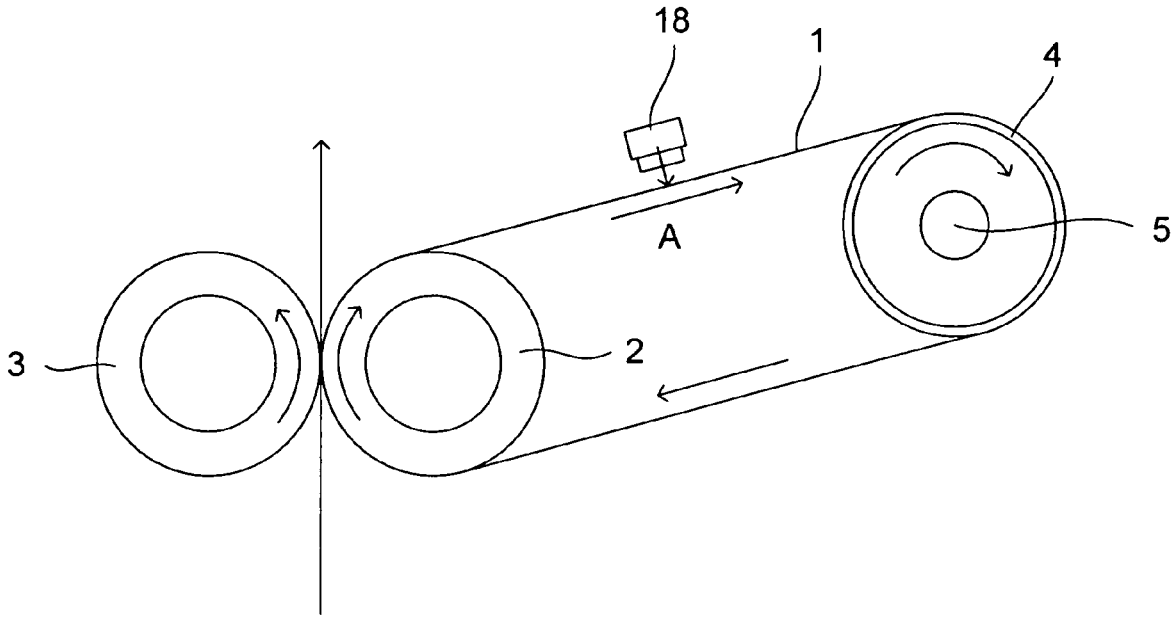
FIG. 13 is a diagram showing an outline of the construction of a third embodiment for controlling the fixing temperature in the belt fixing unit embodying the present invention.

A third embodiment of the present invention for controlling the fixing temperature will be described below with reference to FIG. 13. As shown in FIG. 13, a non-contact temperature sensor 18 is provided on a non-contact basis in the paper passage region on the surface of the fixing belt 1, in a predetermined position midway along the transport passage of the fixing belt 1 (a position facing the fixing belt 1 that is located midway between the heating roller 4 and the fixing roller 2 with respect to the belt rotation direction). With the temperature sensor 18 so arranged, the surface temperature of the fixing belt 1 is sensed at the part thereof located midway along the transport passage thereof from the fixing position to the heated position. This offers the advantages that how much heat is lost during the heat rejection process can be accurately known, and that the result of the sensing can be directly reflected in how the heating of the belt is controlled and how the fixing temperature is controlled.

Figure 14:
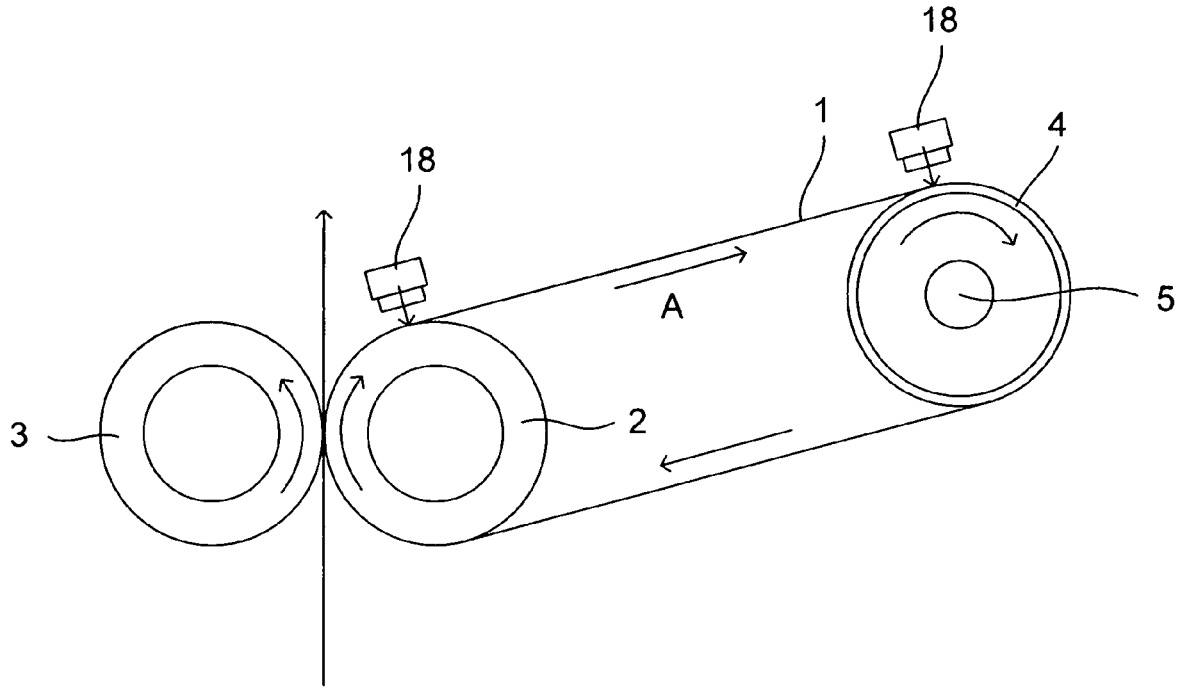
FIG. 14 is a diagram showing an outline of the construction of a fourth embodiment for controlling the fixing temperature in the belt fixing unit embodying the present invention.

A fourth embodiment of the present invention for controlling the fixing temperature will be described below with reference to FIG. 14. As shown in FIG. 14, two non-contact temperature sensors 18 are provided in the paper passage region on the surface of the fixing belt 1, one in a position facing the heating roller 4 and another in a position facing the fixing roller 2. Arranging the temperature sensors 18 in this way offers the advantage that, based on the gradient between the results of the two temperature sensors 18, it is possible to control the fixing temperature in more practical terms.

Figure 15:
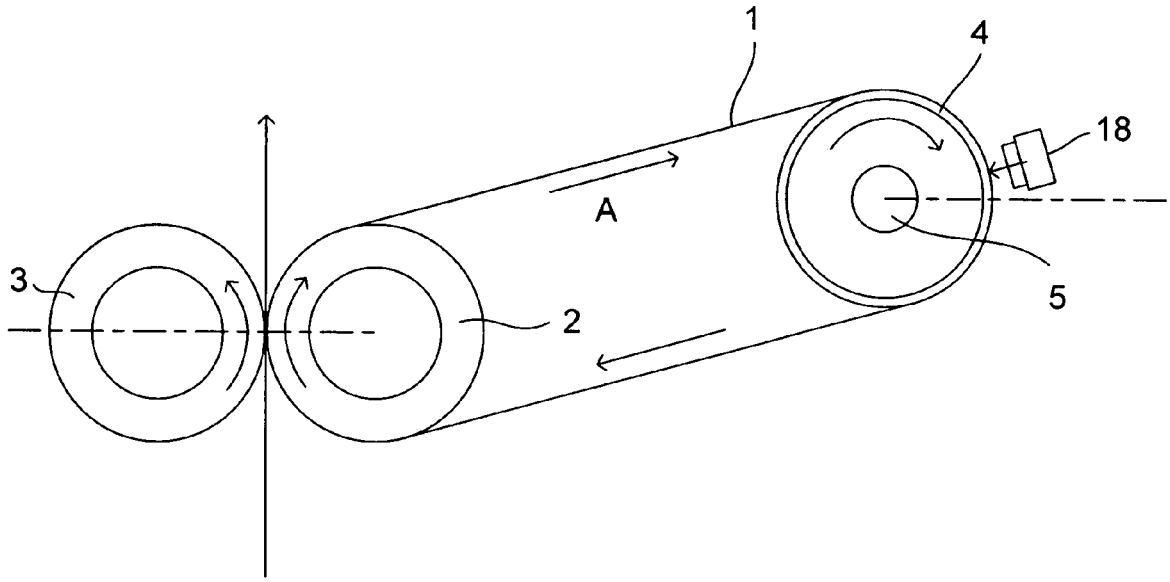
FIG. 15 is a diagram showing an outline of the construction in which the temperature sensor is located at the limit of where it can be located in the belt fixing unit embodying the present invention.
Figure 16:
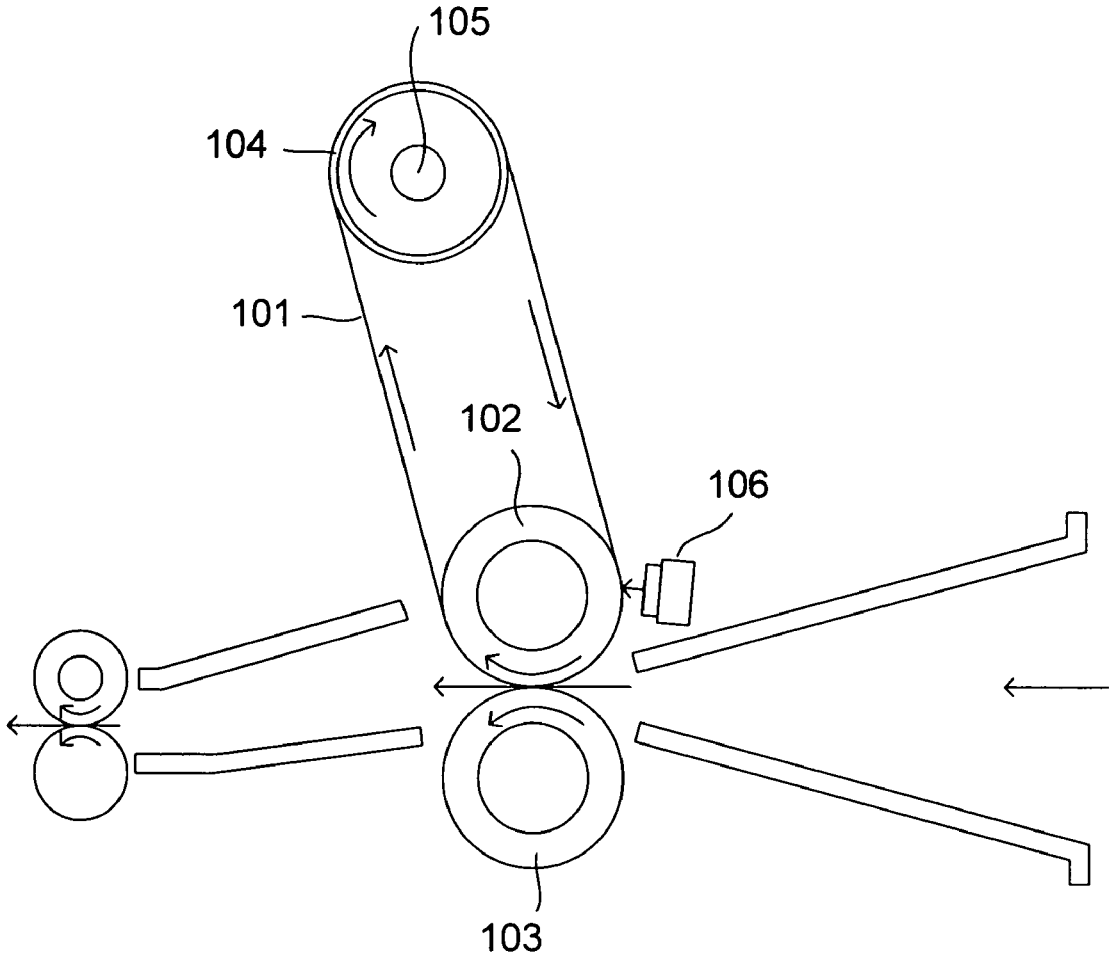
FIG.16 PRIOR ART
FIG. 16 is a diagram showing an outline of a conventional construction for controlling the fixing temperature in a belt fixing unit.

The feature common to the first to fourth embodiments described above with respect to the arrangement of the temperature sensor 18 is that, in all those embodiments, the temperature sensor (or sensors) 18 is located, when its location is considered relative to the fixing belt 1, in the paper passage region on the surface of the upper one of the parts of the fixing belt 1 facing each other up and down between the fixing roller 2 and the heating roller 4. Here, in the part of the fixing belt 1 where it is in contact with the surface of the fixing roller 2, the temperature sensor 18 needs to face the fixing belt 1 at a level above the horizontal line passing through the center of the fixing roller 2; the part of the fixing belt 1 where it is in contact with the surface of the heating roller 4, the temperature sensor 18 needs to face the fixing belt 1 at a level above the horizontal line passing through the center of the heating roller 4 (see FIG. 15). In these constructions, the sensing surface of the temperature sensor 18 points downward approximately in the vertical direction. This makes the sensing surface of the non-contact temperature sensor less prone to be soiled with toner, paper dust, and the like falling from the upper part of the vertical transport passage. Thus, it is possible to control the fixing temperature stably and accurately. Moreover, since heated air tends to rise, it helps stabilize the result of sensing and permits easy control of heating.

It should be understood that many modifications and variations are possible in carrying out the present invention; for example, any number of temperature sensors 18 other than specifically described above may be arranged in any manner other than specifically described above.

What is claimed is:

1. A belt fixing unit comprising:

a fixing member midway along a transport passage through which paper having a toner image formed thereon is transported from bottom to top approximately in a vertical direction, the fixing member fixing the toner image on the paper;

a heating member provided parallel to and in a position approximately horizontal to the fixing member;

a fixing belt formed as an endless belt and wound around and between the fixing member and the heating member, the fixing belt being heated by the heating member and being driven to revolve around and between the fixing member and the heating member; and a non-contact temperature sensor, wherein the temperature sensor is provided on a non-contact basis in a paper passage region on a surface of an upper one of parts of the fixing belt facing each other up and down between the fixing member and the heating member, the temperature sensor being located above a horizontal line through the fixing member or above a horizontal line through the heating member.

2. The belt fixing unit of claim 1, further comprising:

a housing enclosing the belt fixing unit from around, wherein the temperature sensor is fitted to the housing in a position facing the surface of the fixing belt, with a gap kept from the surface of the fixing belt, and wherein, near a temperature sensing part of a sensing device provided in the temperature sensor, a wind shield is provided that points away from the housing toward the fixing belt.

3. The belt fixing unit of claim 1, wherein the wind shield is provided around the temperature sensing part.

4. The belt fixing unit of claim 2, wherein the wind shield is provided, with respect to a rotation direction of the fixing belt, in an upstream-side part of the temperature sensing part.

5. The belt fixing unit of claim 2, wherein, with respect to a rotation direction of the fixing belt, an upstream-side part of the wind shield protrudes perpendicularly toward the surface of the fixing belt.

6. The belt fixing unit of claim 2, wherein, with respect to a rotation direction of the fixing belt, an upstream-side part of the wind shield protrudes with a gentle slope toward the surface of the fixing belt.

7. The belt fixing unit of claim 2, wherein an upstream-side part of the wind shield is so shaped as to taper away toward an upstream side with respect to a rotation direction of the fixing belt.

8. The belt fixing unit of claim 1, wherein, as the temperature sensor, one temperature sensor is provided in a position facing the heating member.

9. The belt fixing unit of claim 1, wherein, as the temperature sensor, one temperature sensor is provided in a position facing the fixing member.

10. The belt fixing unit of claim 1, wherein, as the temperature sensor, one temperature sensor is provided in a position facing the fixing belt, the position being located, with respect to a rotation direction of the fixing belt, midway between the heating member and the fixing member.

11. The belt fixing unit of claim 1, wherein, as the temperature sensor, two temperature sensors are provided, one in a position facing the heating member and another in a position facing the fixing member.

12. The belt fixing unit of claim 1, wherein a sensing surface of the temperature sensor points downward approximately in the vertical direction.

13. The belt fixing unit of claim 3, wherein, in the wind shield, an upstream-side part of the fixing belt with respect to a rotation direction thereof protrudes perpendicularly from the sensing surface of the temperature sensor toward the surface of the fixing belt.

* * * * *